US011710470B2

(12) United States Patent
Cooke

(10) Patent No.: US 11,710,470 B2
(45) Date of Patent: Jul. 25, 2023

(54) HAND HELD MUSICAL INSTRUMENTS

(71) Applicant: Richard Cooke, Hesperus, CO (US)

(72) Inventor: Richard Cooke, Hesperus, CO (US)

( * ) Notice: Subject to any disclaimer, the term of this patent is extended or adjusted under 35 U.S.C. 154(b) by 144 days.

(21) Appl. No.: 17/377,001

(22) Filed: Jul. 15, 2021

(65) Prior Publication Data

US 2023/0012735 A1 Jan. 19, 2023

(51) Int. Cl.
*G10D 13/06* (2020.01)
*G10D 13/12* (2020.01)

(52) U.S. Cl.
CPC ..... *G10D 13/06* (2013.01); *G10D 13/12* (2020.02)

(58) Field of Classification Search
CPC ..... G10D 13/06; G10D 13/12; G10D 13/00
See application file for complete search history.

(56) References Cited

U.S. PATENT DOCUMENTS 10,650,793 B2 5/2020 Cooke

FOREIGN PATENT DOCUMENTS

CN 206421812 U * 8/2017 ..... G10D 13/06

OTHER PUBLICATIONS https://www.sweetwater.com/store/detail/LP231A--latin-percussion-agogo-bells-standard; Jan. 2013 ; ALL.*
D.Lavan, et al., "Why Do Bell Plates Ring?", Acoustics Australia, vol. 31, Aug. 2003, pp. 1-4.
D.Lavan, et al., "Acoustics of bell plates", The University New South Wales, Sydney, Australia, https://newt.phys.unsw.edu.au/jw/bellplates.html, 8 pages.
Belleplates website, https://www.belleplates.co.uk, 5 pages.

* cited by examiner

*Primary Examiner* — Kimberly R Lockett
(74) *Attorney, Agent, or Firm* — McAndrews, Held & Malloy, Ltd.

(57) ABSTRACT

The present disclosure is directed to a hand-held musical instrument comprising a first metal plate or portion of a metal plate configured to emit a sound having a first note when struck with a mallet, and a second metal plate or portion of a metal plate configured to emit a sound having a second note when struck with a mallet, with the first and second plates/portions being connected by a handle that is sized and configured to be held by a human hand. The instrument may be held in one hand and the plates/portions struck with a mallet using the other hand. Embodiments of the musical instrument produce complementary notes that are free of interference from one another and that each have a gradual decay rate, leading to a relatively long sustain time.

20 Claims, 10 Drawing Sheets

HAND HELD MUSICAL INSTRUMENTS

BACKGROUND

The ability of a metal plate to produce a desirable sound when struck has been utilized to make a musical instrument known as a bell plate and sold commercially under the name BELLEPLATES®. Bell plates consist of a handle attached to a polygonal aluminum plate that is tuned to produce a sound of a defined pitch/note when struck and an attached hammer that is used to strike the aluminum plate. Bell plates are played similarly to hand bells, which has led to their use primarily in churches and hand bell choirs.

The ability of a metal plate to produce a desirable sound when struck has also been utilized for the production of the musical instruments for outdoor installation described in U.S. Pat. No. 10,650,793 B2, of which I am the named inventor, and sold commercially by FreeNotes Harmony Park™. Though the metal plates of those instruments do emit a sound or number of different sounds when struck with an associated mallet, however, the produced sound(s) is not of a precisely defined pitch/note. Rather, those instruments were developed for a playground setting, and the metal plates provided with curvilinear edges in order to avoid corners. The curvilinear edges prevent the metal plates from being acoustically precise.

Apart from the above, it is believed that the ability of a metal plate to produce a desirable sound when struck has not been utilized in the development of any other musical instruments.

The field of sound therapy, also known as sound healing, is typically practiced using instruments such as singing bowls, gongs, and tuning forks. However, there is a vast opportunity for the development of new instruments that are designed and/or configured for use in sound therapy.

The musical instrument that is the subject of the present disclosure is a new instrument having significant benefits in sound healing and also having potential uses in a variety of different types of music, including for example in theater productions, cinema scores, and the like.

SUMMARY OF THE INVENTION

Embodiments of the present disclosure are directed to a portable, hand-held musical instrument that comprises a first polygonal metal plate or portion of a metal plate that is configured to emit a sound having a first pitch corresponding to a first note when struck with a mallet and a second polygonal metal plate or portion of a metal plate that is configured to emit a sound having a second pitch corresponding to a second note when struck with the same mallet. The musical instrument further comprises a handle that connects the first polygonal metal plate or portion and the second polygonal metal plate or portion, and which is sized and configured to be easily held by a human hand. In some embodiments, the musical instrument comprises a single metal plate having a first polygonal portion and a second polygonal portion connected by an integral connecting portion that serves as the handle (or a portion thereof). This embodiment is preferred because it avoids interference that is produced by attachment of separate polygonal metal plates to a handle structure.

The instrument may be configured so that a user hold the instrument in one hand, and use the other hand to strike the first portion (or plate), the second portion (or plate), or both with a mallet. The pitch produced when the second portion (or plate) is struck, e.g. with the mallet, may differ from the pitch produced when the first portion (or plate) is struck. To achieve those different pitches, the second polygonal portion (or plate) may have a surface area that differs from the surface area of the first polygonal portion (or plate).

Moreover, the note produced when the second portion (or plate) is struck, e.g. with the mallet, may have any of a variety of relationships with the note produced when the first portion (or plate) is struck, such that when both the first and second portions (or plates) are struck, the instrument produced a desired harmonic. In some embodiments, for example, the first note and the second note may be fifths, thirds, or octaves, though other known relationships are also contemplated.

The musical instrument is desirably configured so that when the first portion (or plate) is struck, the first note resonates for up to at least 30 seconds of sustain time and when the second portion (or plate) is struck, the second note resonates for up to at least 30 seconds of sustain time. Relatedly, the musical instrument does not require any resonator; rather the sustain times may be achieved through careful control of the material, geometry, and proportions of the metal plate. For instance, it has surprisingly been found that the connecting portion may be configured so that the user's hand causes substantially no vibrational damping, i.e. very little vibration is dissipated into the hand of the holder and the bulk of the vibration is concentrated in the plate and opposed solely by the density of the surrounding air.

The musical instrument is also desirably configured so that when the first portion and the second portion are both struck, the instrument emits the first note and the second note without interference from one another. Similarly, the musical instrument is desirably configured so that the first note and the second note decay evenly, such that the first note and the second note have substantially the same sustain time when the first portion and the second portion are struck with substantially the same level of force. To achieve these effects, embodiments of the musical instrument comprise a first portion (or plate) and a second portion (or plate) having proportions within a specified range.

In some embodiments, for example, each of the first portion (or plate) and the second portion (or plate) comprises a distal edge which is substantially perpendicular to a longitudinal axis of the instrument, first and second side edges, each of which is substantially parallel to the longitudinal axis of the instrument, and first and second proximal edges, each of which is angled inward from the side edge toward the central connecting portion. The connecting portion may be generally aligned with the longitudinal axis of the instrument. Each of the first portion (or plate) and the second portion (or plate) may satisfy a relationship whereby a ratio x:y is between about 3.8:1 and about 4.1:1, in which x is the distance from an innermost point of each of the proximal edges to the distal edge, and y is the length of each of the first and second side edges.

In some embodiments, the musical instrument may be configured so that when the first portion and the second portion are both struck, the instrument emits a third sound in addition to the harmonic produced by the first and second notes. The third sound has a much lower pitch than the first and second notes and serves to increase the fullness of the tone emitted by the instrument. It is believed that the third sound is produced by the vibration of the metal plate as a whole.

The musical instrument may also be configured such that the sound emitted when the first portion (or plate), the second portion (or plate), or both are struck is directional. More particularly, the sound produced by striking one or both portions (or plates) radiates perpendicular to the faces of the first portion (or plate), the faces of the second portion (or plate), or both. This allows a user to control the volume of the note or notes for a particular individual or group of individuals and to create a variety of sound effects, including for example volume vibrato, which may be created by twisting the plate in a user's hand.

Embodiments of the present disclosure are also directed to a set of musical instruments, including for instance a set of musical instruments as described herein in which each musical instrument produces notes on the same scale. The musical instruments described herein may find particular application in musical education, theater and/or cinematic performances, and sound therapy (also known as sound healing). As such, embodiments of the present disclosure are also directed to a musical instrument that is configured for use in sound therapy, and to methods of performing sound therapy utilizing the musical instruments described herein.

BRIEF DESCRIPTION OF THE DRAWINGS

A clear conception of the advantages and features of one or more embodiments will become more readily apparent by reference to the exemplary, and therefore non-limiting, embodiments illustrated in the drawings.

DETAILED DESCRIPTION OF THE INVENTION

Figure 1:
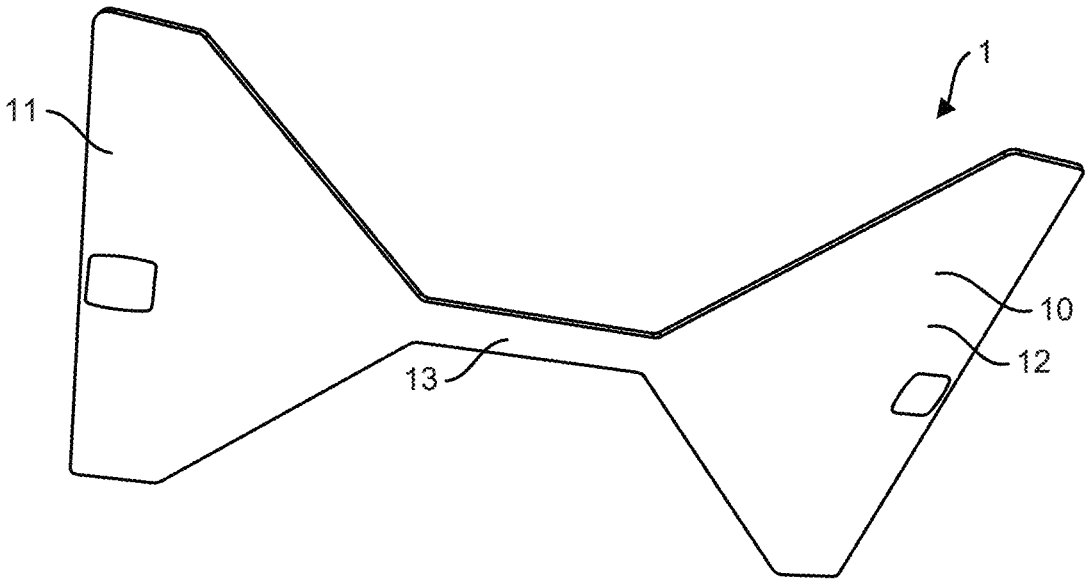
FIG. 1 is a perspective view of an embodiment of a musical instrument of the present disclosure.
Figure 2:
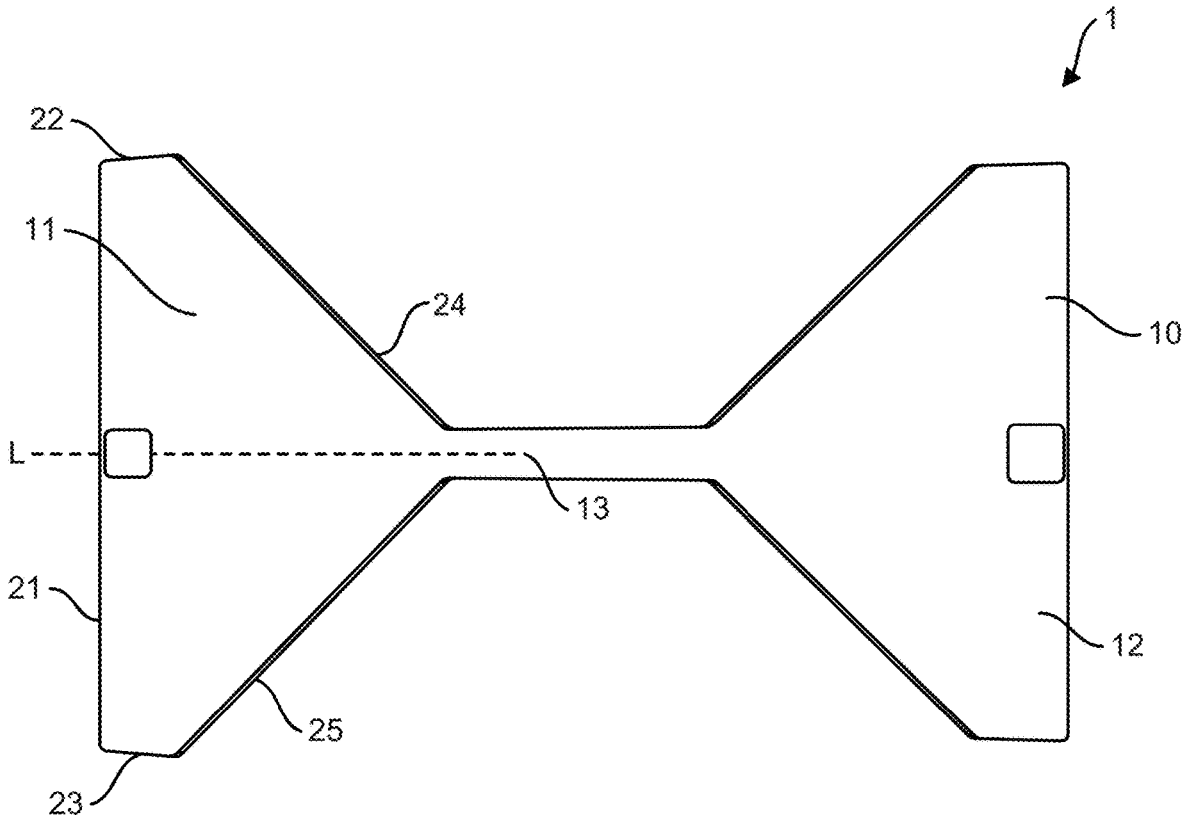
FIG. 2 is a top plan view of the embodiment shown in FIG. 1.

Embodiments of the present disclosure are directed to a hand-held musical instrument 1 and/or to a set of such instruments.

One such embodiment is shown, for example, in FIGS. 1 to 4. The illustrated embodiment comprises a metal plate 10 having a first polygonal portion 11, a second polygonal portion 12, and a connecting portion 13 that spans between the first portion and the second portion. Alternatively, this embodiment can be described as comprising a first polygonal metal plate, a second polygonal metal plate, and a handle that spans between and connects the first and second metal plates, in which the first and second metal plates and at least a portion of the handle are integral with one another. The first polygonal portion 11 is configured to emit a sound of a first note when struck with a mallet 50. The second polygonal portion 12 is configured to emit a sound of a second note when struck with the mallet 50. The connecting portion 13 is sized and configured to be held by a user's hand, leaving the other hand free to hold the mallet 50.

As shown in the embodiment illustrated in FIGS. 1-4, each of the first portion 11 and the second portion 12 may have the same general polygonal shape. More particularly, each of the first portion 11 and the second portion 12 may comprise a distal edge 21 which is substantially perpendicular to a longitudinal axis of the instrument, indicated by the reference L, first and second side edges 22, 23, each of which is substantially parallel to the longitudinal axis of the instrument, and first and second proximal edges 24, 25, each of which is angled inward from the side edge toward the connecting portion 13.

Although this shape is reminiscent of that of a bell plate, embodiments of the present musical instrument have been developed to have a more tightly defined geometry that (a) allows for the two portions 11, 12 to be played, i.e. struck with a mallet 50, simultaneously without interference from the opposing portion and (b) provides each portion 11, 12 with a gradual dissipation of kinetic energy and a corresponding long sustain time on the scale of 30+ seconds.

Figure 3:
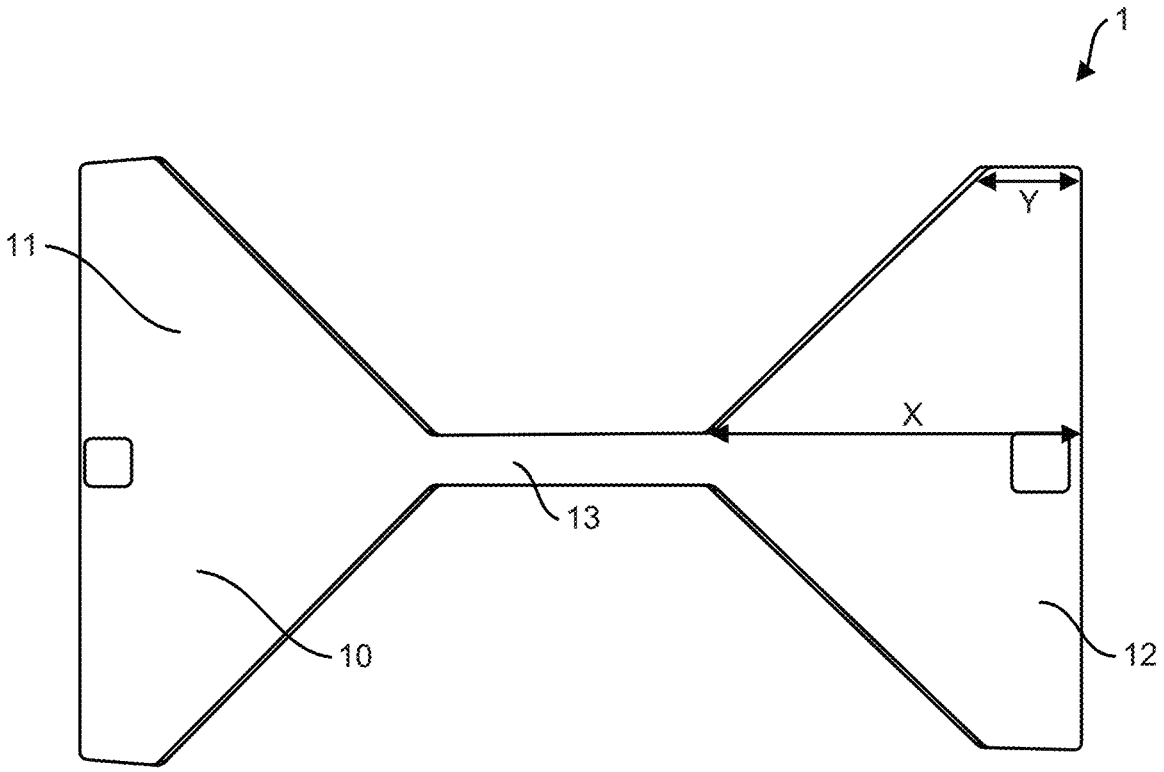
FIG. 3 is a top plan view of the embodiment shown in FIG. 1, showing certain dimensions utilized to produce notes having desired sounds and sustain times.
Figure 4:
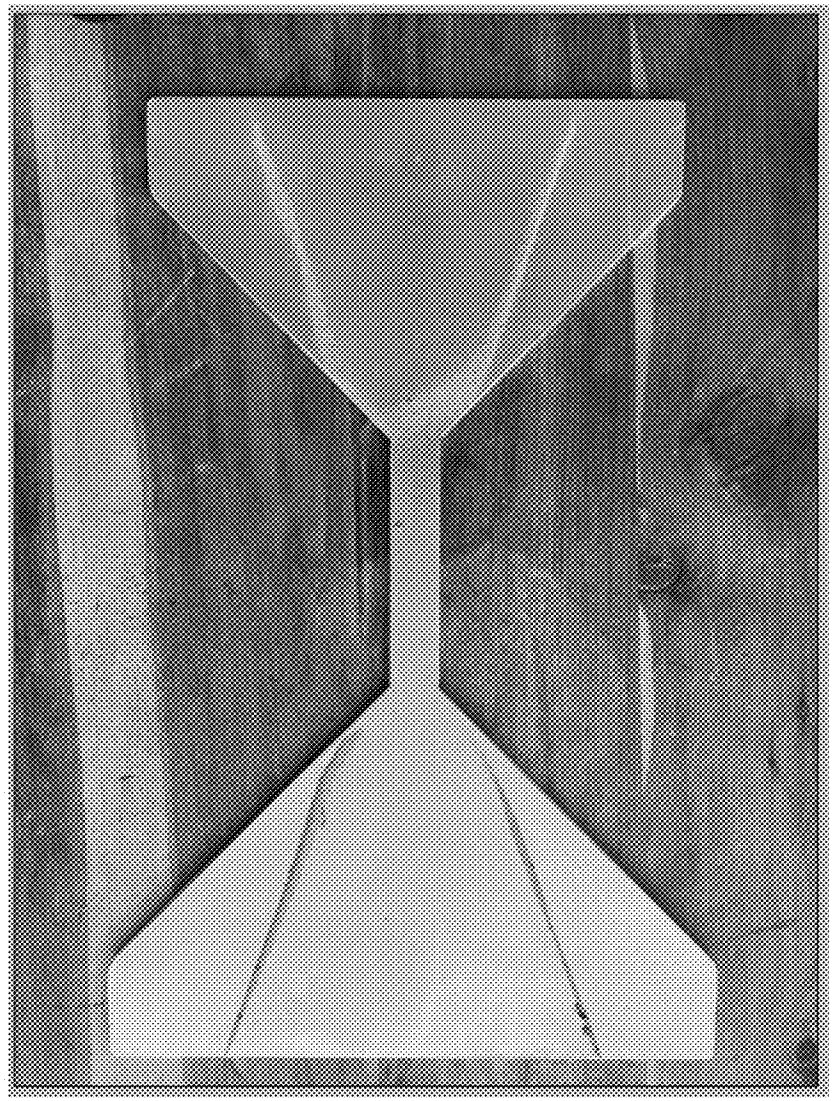
FIG. 4 is a photograph of the embodiment shown in FIG. 1, showing experimental results demonstrating that the node lines coalesce at the apex of the plates.

For example, in some embodiments, the first and second portion may each satisfy the proportional relationship shown in FIG. 3, namely that the ratio x:y is between about 3.8:1 and about 4.1:1, in which x is the distance from an innermost point of each of the proximal edges 24, 25 (i.e., the location where the proximal edge intersects and merges into the connecting portion 13) to the distal edge 21, and y is the length of each of the first and second side edges 22, 23. In some embodiments, the ratio of x:y of the first portion 11 may be identical or substantially identical to the ratio of x:y of the second portion 12. By ensuring that the first and second portions 11, 12 satisfy this proportional relationship, it has surprisingly been found that the note produced by the first portion 11 does not interfere with and/or dominate the note produced by the second portion 12. The above-stated proportional relationship was determined through significant experimentation, as many other geometries resulted in interference between the first and second portions 11, 12 with the result being that the harmonic produced by the simultaneous playing of the first and second portions is not achieved and/or not maintained for the sustain time of the notes. Because a bell plate produces only a single note, the geometry of a bell plate is not so limited.

By ensuring that the first and second portions 11, 12 satisfy this proportional relationship, it has also been found that the instrument can be configured so that the vibration of the first portion 11 and the vibration of the second portion 12 may only be substantially opposed by the density of the surrounding air, leading to long sustain times and even decay rates. While a very minor amount of vibration may be dissipated into the hand of the user, the vast majority is concentrated in the plate and only opposed by the surrounding air. As a result, the decay rate of the note produced by the first portion 11 and the decay rate of the note produced by the second portion 12 may be the same or substantially the same, such that the harmonic produced by the combination of the first and second notes is maintained throughout or substantially throughout the sustain time of the instrument when both portions 11, 12 are struck. Because this harmonic may be selected to produce a relaxing effect, and the relaxing effect may be sustained uninterrupted for a relatively long period of time, it is believed that embodiments of the instrument 1 may have significant beneficial use in sound healing.

In other embodiments, and particularly where a shorter sustain time is desirable, the first and second portion may each have a proportional relationship in which the ratio x:y is not between about 3.8:1 and about 4.1:1. For instance, in some embodiments, the first and second portion may each have a ratio x:y that is less than 3.8:1, e.g. between about 3.0:1 and about 3.7:1, alternatively between about 3.5:1 and 3.7:1, or a ratio x:y that is greater than 4.1:1, e.g. between about 4.2:1 and 5.0:1, alternatively between about 4.2:1 and about 4.5:1. More generally, in some embodiments, the first and second portion may each have a ratio x:y that is between about 3.0:1 and about 5.0:1, alternatively between about 3.5:1 and about 4.5:1.

The metal plate 10 may be prepared so that a first desired note is produced when the first portion 11 is struck and a second desired note is produced when the second portion 12 is struck. By producing the metal plate 10 of precise dimensions, no tuning of the instrument 1 may be required, i.e., on production the metal plate 10 will provide a first portion 11 that is tuned to produce the first note and a second portion 12 that is tuned to produce the second note. However, if necessary, the pitch of the first or second portion 11, 12 may be shifted upward, i.e. to make the note sharper, by removing a small amount of material from the portion 11, 12 near one or more of the edges, or downward, i.e. to make the note flatter, by removing a small amount of material from at or near the middle of the portion 11, 12. Each portion 11, 12 may be configured/tuned to produce any desired note.

In some embodiments, each of the first and second portion 11, 12 may be prepared to have a high degree of precision, e.g. a frequency that is within about 5 Hz of the frequency of the desired note, alternatively within about 3 Hz of the frequency of the desired note, alternatively within about 2 Hz of the frequency of the desired note, alternatively within about 1 Hz of the frequency of the desired note, alternatively within about 0.5 Hz of the frequency of the desired note, alternatively within about 0.2 Hz of the frequency of the desired note.

Generally, it is desirable that the first portion 11 and the second portion 12 be tuned to produce different pitches, and optionally different notes (though in some embodiments the first and second portions 11, 12 may be tuned to produce the same note but in different octaves). The pitch of the sound produced by the vibration of each portion 11, 12 depends on the surface area of the portion, meaning that the first portion may generally have a larger surface area than the second portion or vice versa.

The first note and the second note may have any of a variety of relationships, thereby producing any of a variety of harmonic effects. The particular relationship between the notes, and thus the harmonic created by the striking of both the first and second portions 11, 12, may be selected from any musical interval to achieve a desired effect. In some embodiments, the first portion 11 and the second portion 12 may be configured so that the first note and the second note are of any one of the following intervals: fifths, thirds, or octaves. In particular, these musical intervals are believed to produce particularly pleasing harmonies, though as noted above, the instrument may be configured to produce first and second notes having any relationship.

As an example, the first portion 11 may be sized and configured to produce a F note when struck and the second portion 12 may be sized and configured to produce a C note when struck, with the first portion having a larger surface area than the second portion, thereby producing a harmonic fifth when both portions are struck. As another example, the first portion 11 may be sized and configured to produce a C note when struck and the second portion 12 may be sized and configured to produce a G note when struck, with the first portion having a larger surface area than the second portion, thereby producing a harmonic fifth when both portions are struck. Other examples of a musical instrument that produces a harmonic fifth include first and second portions having the following relationships: D/A, E/B, G/D, etc. (in each instance, the portion with the larger surface area is listed first). Examples of a musical instrument that produces a harmonic third include first and second portions having the following relationships: C/E, E/G, etc. (in each instance, the portion with the larger surface area is listed first).

As noted above, the musical instrument 1 may also be configured so that the note produced when either the first portion 11 and the second portion 12 is struck (or the combination of notes produced when both portions are stuck) resonates or sustains for a relatively long period of time. In some embodiments, for example, the musical instrument 1 may be configured so that each note may sustain for at least 10 seconds, alternatively at least 15 seconds, alternatively at least 20 seconds, alternatively at least 25 seconds, alternatively at least 30 seconds, alternatively at least 35 seconds, alternatively at least 40 seconds. In some embodiments, and particularly where the instrument 1 is to be used for sound therapy, it may be desirable that the musical instrument be configured such that each note sustains for at least 30 seconds, alternatively at least 35 seconds, alternatively at least 40 seconds, alternatively between about 30 and about 40 seconds. Without being bound by theory, it is believed that a sustain of a note—or more preferably a harmonic produced by a combination of notes—for this length of time produces a neurological benefit because it is fairly easy for a person to concentrate on the note or harmonic for a length of time for which it is difficult for most individuals to concentrate on something.

Embodiments of the musical instrument also lends itself to sound therapy for a number of reasons. First, the gradual and even decay rate of the note or harmonic produced by the combination of notes produces a relaxing effect. The decay characteristics of the instrument were achieved via experimentation with the geometry of the first and second portions 11, 12, as a decay rate that is either too gradual or too fast will not produce the same relaxing effect. Relatedly, without being bound by theory, it is believed that a sustain of a note—or more preferably a harmonic produced by a combination of notes—for a relatively long period of time produces a neurological benefit because a person may be able to concentrate on the note or harmonic for a length of time for which it is difficult for most individuals to concentrate on something.

Second, though the hand which holds the connecting portion 13 or handle does not substantially dampen the sound produced by striking the first and/or second portions 11, 12, a user of the instrument does experience a tactile sensation in that the user can feel the vibration of the first and/or second portions 11, 12. Without being bound by theory, this vibrational transfer to the user's hand is believed to have therapeutic value, as the connecting portion 13 or handle can be placed on different parts of a person's body, e.g. the forehead or any of a variety of joints (elbow, knee, ankle, wrist, etc.), and the vibrational information of the note or harmonic can be transferred to that portion of the person's body without damping of the sound.

Further, and notably, when both the first portion 11 and the second portion 12 are struck, and in addition to the harmonic produced by the combination of the first note and the second note, the musical instrument 1 produces a unique third sound, which is the sound of the vibration of the instrument as a whole. The third sound is a low tone having a frequency between about 45 Hz and 110 Hz, and being significantly lower than the first and second notes, provides an interesting and pleasing roundness/fullness to the overall sound/harmonic produced by the musical instrument. In some embodiments, for example, the third sound may have a frequency that is between about 1.5 to about 2 times lower than at least one of, and typically both, of the first and second notes. This low tone may play a role in the therapeutic benefits that can be provided by the musical instrument, as it contributes to the relaxing effect produced by the instrument and may be focused on by an individual. Without being bound by theory, it is believed that the third sound may actually be two different pitches/notes, but given that the two pitches/notes are very close together and very low, they are heard by the human ear as a single low tone.

The musical instrument is also directional, with the sound produced by the first portion 11 and/or the second portion 12 radiating perpendicular to the metal plate 10. This allows a person to direct the sound toward or away from an individual or group of individuals as desired. It also allows a person to create volume vibrato by twisting the plate around in his/her hand. The result is that a user has a large degree of control over what an individual or group of individuals hears, e.g. either the sound(s) directly, the echo of the sound(s) in the room, or one or more transitions between the two. This ability renders the musical instrument 1 useful not only for sound theory, but also potentially for theater and other performances.

Further, the musical instrument is simple and intuitive for a user to play the instrument. No training or instruction may be required—rather a person may naturally understand to strike each of the first and second portions 11, 12 with a mallet. While striking any portion of the first or second portion 11, 12 will cause that portion of the instrument to vibrate and produce the associated pitch/note, the richest and most well-sustaining pitch/note is produced by striking the portion 11, 12 centrally and relatively near the distal edge 21. In some embodiments, the first portion 11, the second portion 12, or both may be provided with a visual marking, or indicator, identifying the ideal location for striking. The marking may be provided in any of a variety of manners, as would be understood by one of skill in the art, including for example brushed into the metal plate 10 itself. The ease of the instrument to play and the ability to tune the instrument to produce different harmonics renders the musical instrument 1 of the present disclosure particularly desirable for use in musical education and in schools.

In some embodiments, the notes produced by each of the first and second portions 11, 12 may be identified somewhere on the musical instrument in order to differentiate from other units. For example, each portion 11, 12 may have a marking identifying the note produced or the connecting portion 13 may have a marking identifying the notes produced by the instrument. As above, the marking may be provided in any of a variety of manners, as would be understood by one of skill in the art, including for example brushed into the metal plate 10 itself.

The metal plate 10 may be produced from any of a variety of metals. In some preferred embodiments, the metal plate 10 may be aluminum or an aluminum alloy. It has been found that plates made from aluminum and aluminum alloys can be tuned to consistently produce a pitch of a particular note when struck by a mallet, are relatively inexpensive to produce, produce a warm tone (e.g. relative to steel and other metals which are much harder) and are lightweight, making the instrument easy to hold. In general, harder aluminum may be preferred to softer aluminum, as harder aluminum will sustain a vibration for longer than a relatively softer aluminum. As an example, an instrument made from 6061-T6 aluminum will sustain the first and second notes longer than an instrument made from 6061-T5 aluminum.

The thickness of the metal plate 10 may also vary, though generally it is desirable that the plate be relatively thin. The thickness of the metal plate 10 will also vary depending on the metal from which the plate is produced. In some embodiments, for instance, the metal plate 10 may be made from aluminum or an aluminum alloy and may have a thickness between about 1/16 inch and 1 inch, alternatively between about 1/8 inch and 7/8 inch, alternatively between about 1/8 inch and 5/8 inch, alternatively between 1/8 inch and 1/2 inch, alternatively between 1/8 inch and 1/4 inch, alternatively about 3/16 inch.

The connecting portion 13 of the metal plate 10 may be sized and configured for a user to easily grasp the connecting portion in his/her hand and hold the instrument 1 in one hand while holding a mallet 50 in the other hand. As in the embodiment illustrated in FIGS. 1-4, the connecting portion 13 may be an integral part of the same metal plate 10 that forms the first and second portions 11, 12. Optionally, the instrument may also comprise a handle that may surround or partially surround at least a portion of the connecting portion 13, thereby providing a softer gripping surface that may be more comfortable to hold over time. As it has surprisingly been found that a user's hand on the connecting portion 13 does not substantially damp the vibrations of the first and second portions 11, 12, it is desirable that the handle be configured and applied to the connecting portion 13 in a manner that also not damp those vibrations.

As shown in the illustrated embodiments, the connecting portion 13 may be straight or substantially straight, such that the first and second portions 11, 12 lie in the same or substantially the same plane, i.e. the angle between them is about 180 degrees. In other (non-illustrated) embodiments, the connecting portion 13 may be curved, twisted, or bent, such that the first and second portions 11, 12 are placed at an angle with one another. In some embodiments, for instance, the connecting portion 13 may be configured such that the first and second portions form an angle between about 179 degrees and about 90 degrees.

Figure 5:
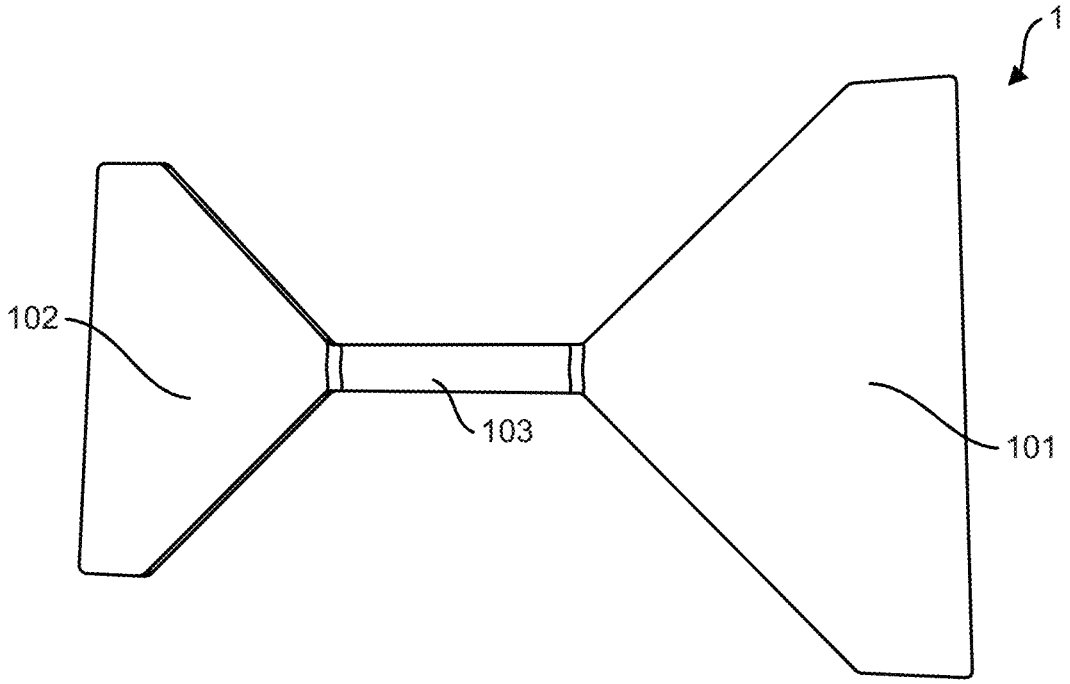
FIG. 5 is a perspective view of another embodiment of a musical instrument of the present disclosure, in which the first and second plates are welded to a handle.
Figure 6:
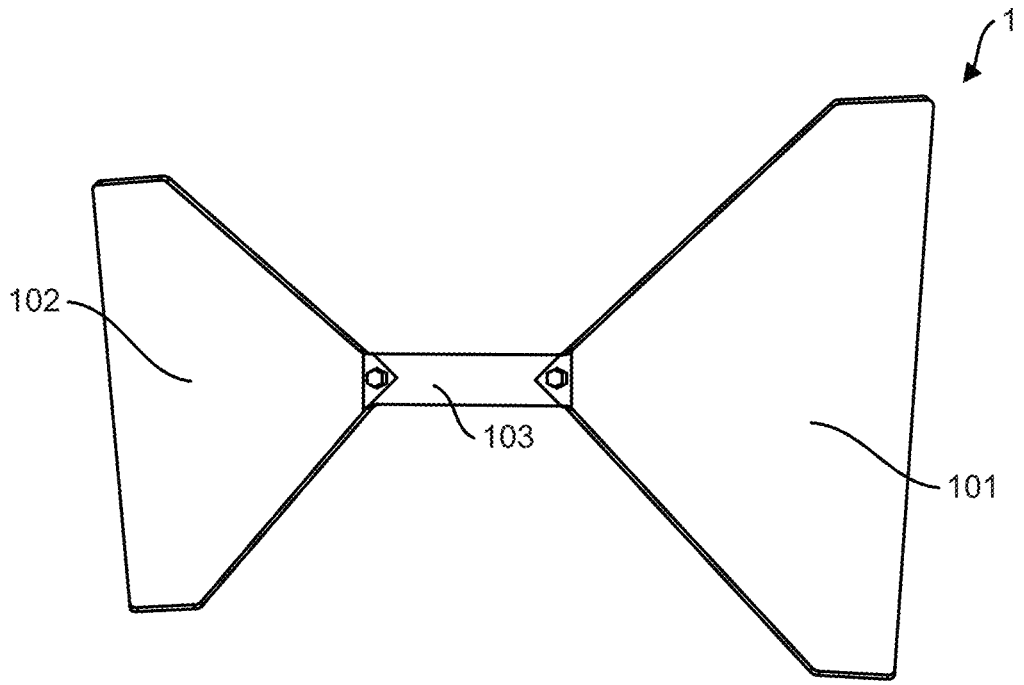
FIG. 6 is a perspective view of another embodiment of a musical instrument of the present disclosure, in which the first and second plates are attached to a handle by fasteners (here, bolts).

Although the instrument 1 has been described with respect to an embodiment in which the first and second portions 11, 12 are part of a single, integral metal plate 10, e.g. as shown in FIGS. 1-4, a similar instrument may be prepared using a first metal plate 101 and a second metal plate 102, each of which is attached to an opposing end of a handle 103. Embodiments of such an instrument 1 are shown in FIGS. 5 and 6. In the embodiment illustrated in FIG. 5, the first metal plate 101 and the second metal plate 102 are each welded to the handle 103. In the embodiment illustrated in FIG. 6, on the other hand, the first metal plate 101 and the second metal plate 102 are each fastened to the handle 103 using one or more fasteners, such as bolts.

Such an instrument 1 may be configured to have many of the same effects as the instrument produced from a single metal plate 10, although the attachment of the first and second metal plates 102 to the handle 103 necessarily produces at least some interference with the vibration of the metal plates 101, 102. The result is an instrument 1 with a sound quality and sustain time that is diminished relative to one made from an integral metal plate 10, such as that shown in FIGS. 1-4.

Figure 7:
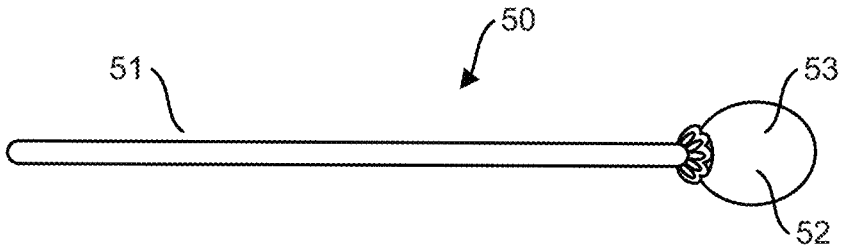
FIG. 7 is a perspective view of an embodiment of a mallet of the present disclosure.

Embodiments of the present musical instrument 1 may also include a mallet 50 that is used to strike the first portion 11 and/or the second portion 12 of the metal plate. The mallet 50 may take on any of a variety of configurations—indeed, the plate 10 can be struck with almost anything and produce the first and second notes. Desirably, however, the mallet may comprise a handle 51, a resilient head 52, and a soft covering 53 to cushion the transient strike tone and ensure that a consistent and relaxing sound is produced upon striking. An example of such a mallet 50 is shown in FIG. 7. In some embodiments, the resilient head 52 may comprise a rubber material having a desired durometer and the soft covering 53 may comprise a fabric covering such as a felt covering that surrounds the resilient head.

Figure 8:
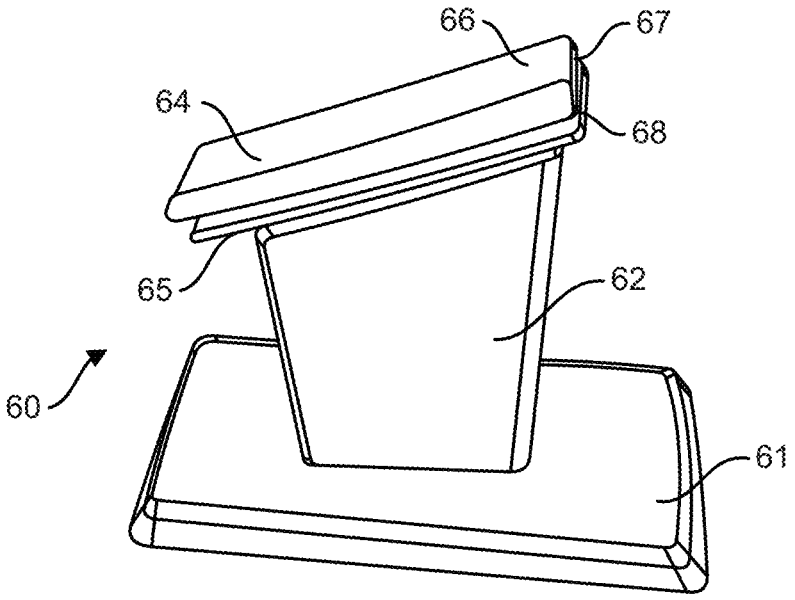
FIG. 8 is an upper, right side perspective view of an embodiment of a stand configured to convert the musical instrument from a hand-held instrument into a standing instrument.
Figure 9:
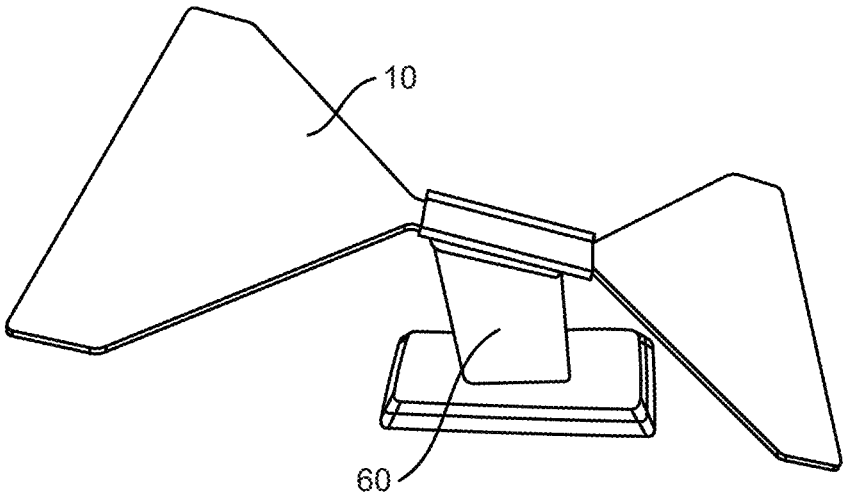
FIG. 9 is an upper, left side perspective view of an embodiment of a musical instrument of the present disclosure held by the embodiment of the stand shown in FIG. 8.
Figure 10:
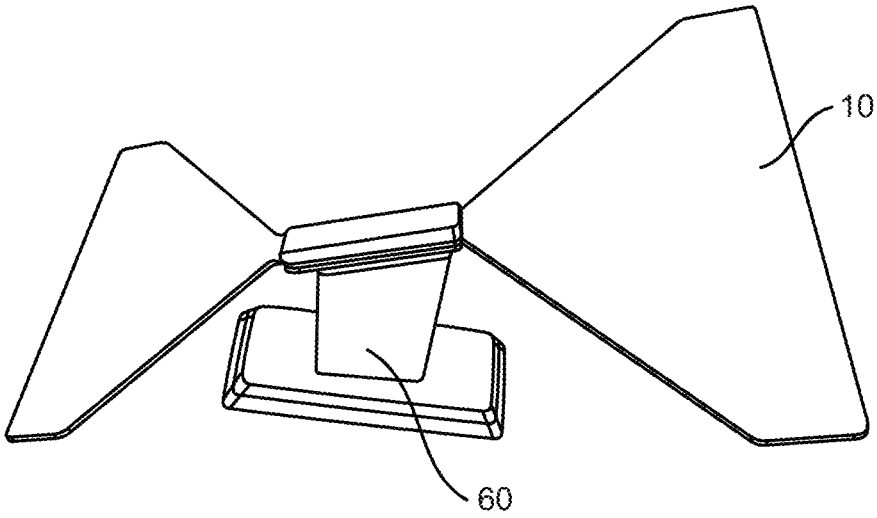
FIG. 10 is an upper, right side perspective view of an embodiment of a musical instrument of the present disclosure held by the embodiment of the stand shown in FIG. 8.

In some embodiments, the musical instrument 1 may also include a stand 60 that is configured to support the metal plate 10 so that it need not be held by a user. An example of such a stand 60 is shown in FIGS. 8 to 10, though other designs are contemplated without departing from the scope of the present invention. As shown in the illustrated embodiment, the stand 60 may include a base 61 and an upward extending element 62, e.g. post, which places the musical instrument 10 in an elevated position relative to the base. The stand 60 also comprises a holder 64, which may be positioned at the upper end of the post 62. In the illustrated embodiment, the holder 64 (and indeed the upper surface of the post 62) is angled, such that one of the first and second portions 11, 12 is placed at a higher elevation than the other. In other embodiments, however, the holder 64 may be placed at any of a variety of different angles, including parallel with the ground or supporting surface.

The holder 64 may comprise a channel 68 configured to receive the connecting portion 13 or handle 103 of the musical instrument 10. In the illustrated embodiment, for example, the holder 64 comprises a bottom wall 65, an upper wall 66, and a side wall 67, with the side opposite side wall 67 being open such that a user can insert the musical instrument 10, and in particular the connecting portion 13 or handle 103, into the channel 68. The channel 68 may be configured and/or dimensioned to hold the musical instrument 10 in place with friction. An embodiment of the musical instrument 10 is shown positioned in stand 60 in FIGS. 9-10.

In other (non-illustrated embodiments), a stand 60 may comprise a plurality of holders 64 all supported by the same base 61. Using either a stand 60 comprising a plurality of holders or a plurality of stands such as that illustrated in FIGS. 8-10, one may arrange a plurality of musical instruments 10 in a desired array or configuration such that they may be played with one or more mallets 50 to produce a variety of harmonics.

It can be seen that the described embodiments provide unique and novel musical instruments 10 that have a number of advantages over those in the art. While there is shown and described herein certain specific structures embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed:

1. A portable musical instrument configured to be held by user and struck with a mallet, the musical instrument comprising:

a first polygonal metal plate configured to emit a sound having a first note when struck with a mallet;

a second polygonal metal plate configured to emit a sound having a second note when struck with a mallet;

a handle that connects the first polygonal metal plate and the second polygonal metal plate and that is sized and configured to be held by a human hand;

wherein each of the first polygonal metal plate and the second polygonal metal plate comprises a distal edge which is substantially perpendicular to a longitudinal axis of the instrument, first and second side edges, each of which is substantially parallel to the longitudinal axis of the instrument, and first and second proximal edges, each of which is angled inward from one of the first and second side edges toward the handle.

2. The portable musical instrument of claim 1, wherein the first polygonal metal plate, the second polygonal metal plate, and at least a portion of the handle are integral with one another.

3. The portable musical instrument of claim 1, wherein the second polygonal metal plate has a surface area that differs from a surface area of the first polygonal metal plate.

4. The portable musical instrument of claim 1, wherein the musical instrument is configured so that the first note and the second note decay evenly, such that the first note and the second note have substantially the same sustain time when the first plate and the second plate are struck with substantially the same level of force.

5. The portable musical instrument of claim 1, wherein the musical instrument is configured so that when the first plate and the second plate are both struck, the instrument emits the first note and the second note without interference from one another.

6. The portable musical instrument of claim 1, wherein the first polygonal metal plate and the second polygonal metal plate each satisfy the following relationship:

a proportion of x:y is between about 3.8:1 and about 4.1:1, in which x is the distance from an innermost point of each of the proximal edges to the distal edge, and y is the length of each of the first and second side edges.

7. The portable musical instrument of claim 1, wherein the instrument is configured so that a user's hand gripping the handle causes substantially no vibrational damping of the first plate and the second plate.

8. The portable musical instrument of claim 2, wherein, when the first plate and the second plate are both struck, the instrument also emits a third sound produced by the vibration of the instrument as a whole.

9. The portable musical instrument of claim 1, wherein the instrument is configured so that each plate has up to at least 30 seconds of sustain time.

10. The portable musical instrument of claim 1, wherein each of the first polygonal metal plate and the second polygonal metal plate is attached to the handle by one or more welds, one or more fasteners, or a combination thereof.

11. The portable musical instrument of claim 1, wherein the first note and the second note are fifths, thirds, or octaves.

12. The portable musical instrument of claim 1, wherein the instrument does not include a resonator.

13. The portable musical instrument of claim 1, wherein each metal plate is aluminum.

14. The portable musical instrument of claim 13, wherein each metal plate has a thickness between ⅛ and ⅝ inches.

15. The portable musical instrument of claim 1, further comprising a mallet configured for striking the first plate and the second plate.

16. A musical instrument comprising:

a metal plate comprising a first portion configured to emit a sound of a first note when struck;

a second portion configured to emit a sound of a second note when struck, the second note being of a different pitch from the first; and a connecting portion;

wherein, when the first portion and the second portion are both struck, the instrument emits the first note and the second note without interference from one another, and wherein the first note and the second note decay evenly, such that the first note and the second note have substantially the same sustain time when the first portion and the second portion are struck with substantially the same level of force.

17. The musical instrument of claim 16, wherein the connecting portion is sized and configured to be held by a user's hand and wherein the instrument is configured so that the user's hand causes substantially no vibrational damping.

18. The musical instrument of claim 17, further comprising a handle at least partially surrounding a portion of the connecting portion.

19. The musical instrument of claim 16, wherein the instrument is configured so that each portion has up to at least 30 seconds of sustain time.

20. A portable musical instrument configured to be held by user and struck with a mallet, the musical instrument comprising:

a first polygonal metal plate configured to emit a sound having a first note when struck with a mallet;

a second polygonal metal plate configured to emit a sound having a second note when struck with a mallet;

a handle that connects the first polygonal metal plate and the second polygonal metal plate and that is sized and configured to be held by a human hand;

wherein the second polygonal metal plate has a surface area that differs from a surface area of the first polygonal metal plate.

* * * * *